US005968724A

United States Patent [19]

Eikenberry et al.

[11] Patent Number: 5,968,724

[45] Date of Patent: Oct. 19, 1999

[54] SILVER HALIDE PHOTOGRAPHIC ELEMENTS WITH REDUCED FOG

[75] Inventors: Jon N. Eikenberry; Roger L. Klaus; Roger L. Lok, all of Rochester; Jerzy Z. Mydlarz, Fairport; Brian S. White, Rochester, all of N.Y.

[73] Assignee: Eastman Kodak Company, Rochester, N.Y.

[21] Appl. No.: 09/177,154

[22] Filed: Oct. 22, 1998

[51] Int. Cl.[6] ..... G03C 1/34; G03C 1/08

[52] U.S. Cl. ..... 430/614; 430/570; 430/615; 430/607

[58] Field of Search ..... 430/570, 614, 430/615, 607

[56] References Cited

U.S. PATENT DOCUMENTS

| | | | |
|---|---|---|---|
| 4,224,403 | 9/1980 | Toda et al. | 430/537 |
| 4,490,462 | 12/1984 | Kawaguchi et al. | 430/543 |

FOREIGN PATENT DOCUMENTS

| | | |
|---|---|---|
| 10-11739 | 1/1998 | Japan . |

OTHER PUBLICATIONS

Japanese Abstract 09–329862.
Japanese Abstract 10–011739.
Japanese Abstract 09–133977.
Research Disclosure No. 37026, Feb. 1995.

*Primary Examiner*—Janet Baxter
*Assistant Examiner*—Amanda C. Walke
*Attorney, Agent, or Firm*—Sarah Meeks Roberts

[57] ABSTRACT

This invention relates to silver halide photographic element comprising a silver halide emulsion chemically sensitized in the presence of an isothiazolin-one compound represented by the formula

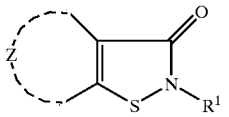

wherein $R^1$ is a substituent; and Z is a substituted or unsubstituted saturated ring, wherein the isothiazolin-one compound was added after precipitation of the emulsion.

21 Claims, No Drawings

SILVER HALIDE PHOTOGRAPHIC ELEMENTS WITH REDUCED FOG

FIELD OF THE INVENTION

This invention relates to the use of isothiazolin-one compounds with light-sensitive silver halide emulsions.

BACKGROUND OF THE INVENTION

Problems with fogging have plagued the photographic industry from its inception. Fog is a deposit of silver or dye that is not directly related to the image-forming exposure, e.g., when a developer acts upon an emulsion layer, some reduced silver is formed in areas that have not been exposed to light. The fog sites on silver halide crystals can originate during emulsion manufacture or during aging of the photographic element. During the aging process, fog can become exaggerated by extremes in temperature and humidity. Fog can be defined as developed density that is not associated with the action of the image-forming exposure, and is usually expressed as "D-min", the density obtained in the unexposed portions of the emulsion. Developed density, as normally measured, includes both that produced by fog and that produced by exposure to light.

An especially critical time in fog formation is during the sensitivity enhancing process. The sensitivity enhancing process constitutes the period from final washing of the precipitated silver halide emulsion to the point where the thermal treatment during chemical/spectral sensitization is completed. At the end of the sensitivity enhancing process, the desired sensitometric properties of, for example, speed, contrast, and reciprocity have been achieved.

Many methods have been employed to minimize the appearance of fog. Mercury-containing compounds, such as those described in U.S. Pat. Nos. 2,728,663; 2,728,664; and 2,728,665, have been used as additives to combat fog. Thiosulfonate and thiosulfonate esters, such as those described in U.S. Pat. Nos. 2,440,206; 2,934,198; 3,047,393; and 4,960,689, have also been employed. Disulfides, such as those described in U.S. Pat. Nos. 3,397,986; 5,219,721; and 5,418,127 have also been found effective in limiting fog, especially when used during the sensitizing process of silver halide emulsion manufacture.

Unfortunately, such fog-combating compounds are not without drawbacks. Many compounds which are useful as antifoggants also reduce speed. Mercury-containing compounds, while being very effective antifoggants are environmentally undesirable.

In this invention it has been discovered that a specific group of isothiazolin-ones is particularly useful in controlling fog when added before or during chemical sensitization. Isothiazolin-ones are known as useful biocides for silver halide photographic elements as described in Research Disclosure 37026, February 1995; in U.S. Pat. Nos. 4,224,403 and 4,490,462; and in JP 09-329862 and JP 10-011739. JP 09-133977 describes one class of isothiazolin-ones as reducing fog when added during precipitation of a silver halide emulsion. However, nowhere has it been recognized or described that a specific group of isothiazolin-one compounds confers significant advantageous sensitometric benefits when used during the sensitivity enhancing process of emulsion manufacture.

SUMMARY OF THE INVENTION

This invention provides a silver halide photographic element comprising a silver halide emulsion chemically sensitized in the presence of an isothiazolin-one compound represented by the formula

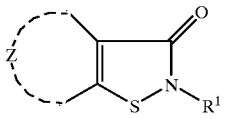

wherein $R^1$ is a substituent; and Z is a substituted or unsubstituted saturated ring, wherein the isothiazolin-one compound was added after precipitation of the emulsion. It further provides a method of making the above described emulsion.

The isothiazolin-ones used in this invention are highly effective at suppressing fog in silver halide emulsions when used during the sensitivity enhancing process of emulsion manufacture. Not only do the isothiazolin-ones reduce fog, but they do so without significantly reducing speed.

DETAILED DESCRIPTION OF THE INVENTION

The isothiazolin-one compounds utilized in this invention are represented by the formula

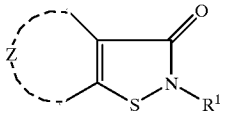

Z is a substituted or unsubstituted saturated ring. Preferably Z is a substituted or unsubstituted five or six-membered saturated ring, and more preferably Z is a substituted or unsubstituted five-membered saturated ring. In one suitable embodiment Z is an unsubstituted saturated five-membered ring.

$R^1$ can be any substituent which is suitable for use in a silver halide photographic element and which does not interfere with the fog restraining activity of the isothiazolin-one compound. Preferably $R^1$ is a substituted or unsubstituted aliphatic, aromatic or heterocyclic group.

When $R^1$ is an aliphatic group, preferably it is an alkyl group having from 1 to 20 carbon atoms, or an alkenyl or alkynyl group having from 2 to 20 carbon atoms. More preferably, it is an alkyl group having 1 to 6 carbon atoms, or an alkenyl or alkynyl group having 3 to 5 carbon atoms. Most preferably it is an alkyl group having 1 to 3 carbon atoms. These groups may or may not have substituents. Examples of alkyl groups include methyl, ethyl, propyl, butyl, pentyl, hexyl, octyl, 2-ethylhexyl, decyl, dodecyl, hexadecyl, octadecyl, cyclohexyl, isopropyl and t-butyl groups. Examples of alkenyl groups include allyl and butenyl groups and examples of alkynyl groups include propargyl and butynyl groups.

The preferred aromatic groups have from 6 to 20 carbon atoms and include, among others, phenyl and naphthyl groups. More preferably, the aromatic groups have 6 to 10 carbon atoms and most preferably the aromatic group is phenyl. These groups may be substituted or unsubstituted. The heterocyclic groups are 3 to 15-membered rings or condensed rings with at least one atom selected from nitrogen, oxygen, sulfur, selenium and tellurium. More preferably, the heterocyclic groups are 5 to 6-membered rings with at least one atom selected from nitrogen. Examples of heterocyclic groups include pyrrolidine, piperidine, pyridine, tetrahydrofuran, thiophene, oxazole, thiazole, imidazole, benzothiazole, benzoxazole, benzirnidazole, selenazole, benzoselenazole, tellurazole, triazole, benzotriazole, tetrazole, oxadiazole, or thiadiazole rings.

Nonlimiting examples of substituent groups for $R^1$ and Z include alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), ether groups (for example methoxy, ethoxy, propoxy, butoxy), hydroxyl and nitrile groups. Preferred substituents are lower alkyl groups, i.e., those having 1 to 4 carbon atoms (for example, methyl), hydroxyl groups, and halogen groups (for example, chloro).

The isothiazolin-ones may be prepared as described in U.S. Pat. Nos. 4,708,959—Shroot et al; 4,851,541—Maignan et al; 5,082,966—Moffat; 5,336,777—Moffat et al; and 5,466,814—Moffat et al, all of which are incorporated herein by reference. Some of them are also available commercially from Zeneca Biocides, Inc., Wilmington, Del.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Nonlimiting examples of suitable substituents are alkyl groups (for example, methyl, ethyl, hexyl), aryl groups (for example, phenyl, naphthyl, tolyl), acyl groups (for example, acetyl, propionyl, butyryl, valeryl), sulfonyl groups (for example, methylsulfonyl, phenylsulfonyl), alkoxy groups, hydroxy groups, alkylthio groups, arylthio groups, acylamino groups, sulfonylamino groups, acyloxy groups, carboxyl groups, cyano groups, sulfo groups and amino groups.

Useful levels of the isothiazolin-one compounds range from about 0.02 to 50 mmol/mol Ag; more preferably 0.05 to 20, and most preferably 0.10 to 5.0. The isothiazolin-one compounds may be used in addition to any conventional emulsion stabilizer or antifoggant as commonly practiced in the art. Combinations of more than one isothiazolin-one compound may be utilized.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The emulsion is then cooled to about 40° C. or less to stop chemical sensitization. The precipitation and spectral and chemical sensitization methods utilized in preparing the emulsions employed in the invention can be any of those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating and extrusion coating.

The silver halide emulsion must be chemically sensitized in the presence of the isothiazolin-one compounds. The isothiazolin-one compounds may be added to the silver halide emulsion at any time after precipitation and before or during the heat treatment employed to effect chemical sensitization. Preferably they are added before chemical sensitization.

Normally the isothiazolin-one compounds are added directly to the emulsion. The compounds may be added to the photographic emulsion using any technique suitable for this purpose. Generally they are dissolved in an aqueous solution and added to the emulsion.

The silver halide emulsions utilized in this invention may be comprised of any halide distribution. Thus, they may be comprised of silver bromoiodide, silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. Preferred compositions are silver bromoiodide and silver iodochloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The isothizolin-one compounds are useful with intentionally or unintentionally reduction sensitized emulsions. As described in *The Theory of the Photographic Process*, Fourth Edition, T. H. James, Macmillan Publishing Company, Inc., 1977 pages 151–152, reduction sensitization has been known to improve the photographic sensitivity of silver halide emulsions. Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23,113 (1979). Examples of processes for preparing intentionally reduction sensitized silver halide emulsions are described in EP 0 348934 A1 (Yamashita), EP 0 369491 (Yamashita), EP 0 371388 (Ohashi), EP 0 396424 A1 (Takada), EP 0 404142 A1 (Yamada), and EP 0 435355 A1 (Makino).

The isothiazolin-one compounds are also particularly useful with emulsions doped with Group VIII metals such as iridium, rhodium, osmium, and iron as described in *Research Disclosure*, September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

The photographic elements suitable for use with this invention may be simple single layer elements or multilayer, multicolor elements. They may also be black and white elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art. The silver halide elements may be reversal or negative elements, or transmission or reflection elements (including color paper).

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as described in *Research Disclosure*, November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure*, June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure*, February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including |
| 3 & 4 | I, II, III, IX A & B | hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical |
| 2 | V | brighteners, luminescent |
| 3 & 4 | VI | dyes |
| 1 | VI | Antifoggants and |
| 2 | VI | stabilizers |
| 3 & 4 | VII | |
| 1 | VIII | Absorbing and scattering |
| 2 | VIII, XIII, XVI | materials; Antistatic layers; matting agents |
| 3 & 4 | VIII, IX C & D | |
| 1 | VII | Image-couplers and image- |
| 2 | VII | modifying couplers; Wash- |
| 3 & 4 | X | out couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as the electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible image, preferably by other than heat treatment.

The following examples illustrate the practice of this invention. They are not intended to be exhaustive of all possible variations of the invention.

EXAMPLE 1

The tabular AgBr emulsion described in Example 1 of U.S. Pat. No. 5,733,717 was chemically sensitized with optimum levels of conventional sulfur and gold sensitizers (EM-1). To increase the emulsion's sensitivity, another portion of the unsensitized emulsion was first treated with an amine borane compound and then given an identical sulfur and gold sensitization (EM-2). The inventive compound I-1 was compared to a mercuric salt (CC-1) and a conventional biocide (B-1) by addition either between the amine borane treatment and the subsequent sulfur and gold sensitization (Before) or following the emulsion sensitization (After). The emulsions were then diluted with gelatin, water, and coating aids and cast onto a blue-tinted cellulose acetate support. The emulsion layers were then hardened with an overcoat containing gelatin, water, coating aids, and a vinylsulfone hardener. The resulting dried coatings containing 2152 mg/m$^2$ of silver halide and 3949 mg/m$^2$ of gelatin were exposed for 0.02 seconds with white light and developed in Kodak RP X-OMAT. Table 1 shows the speeds relative to the coating with no additives or amine borane compound and the minimum density (D-min) of the emulsion coatings.

TABLE 1

| Description | Compound | Placement | Level (μmol/Ag mol) | Relative Speed | D-min |
|---|---|---|---|---|---|
| EM-1 (control) | none | | | 100 | 0.045 |
| EM-2 (control) | none | | | 110 | 0.218 |
| Comparison | CC-1 | Before | 0.1 | 71 | 0.032 |
| Comparison | B-1 | Before | 100 | 148 | 0.331 |
| Invention | I-1 | Before | 100 | 132 | 0.164 |
| Invention | I-1 | Before | 1000 | 74 | 0.036 |
| Comparison | B-1 | After | 100 | 145 | 0.292 |
| Comparison | I-1 | After | 100 | 141 | 0.315 |
| Comparison | I-1 | After | 1000 | 129 | 0.226 |

The results in Table 1 demonstrate the unexpected antifogging effect from the isothiazolin-one I-1 when added prior to the commencement of chemical sensitization. Used in this way, I-1 was as effective as the mercuric salt and allows an environmentally desirable means for fog reduction. Such an effect was not observed from the comparative biocide, B-1. This antifogging effect was also not evident when the isothiazolin-one I-1 was added after chemical sensitization. The appropriate amount of I-1 to give desired sensitivity and minimum density can be obtained by one skilled in the art.

I-1

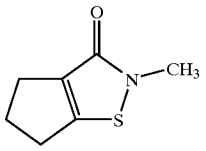

Mercuric Salt CC-1 bis(2-amino-5-iodopyridine)mercuric iodide)

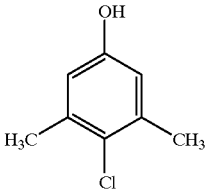

Biocide B-1

EXAMPLE 2

Further portions of the emulsion used in Example 1 were again sensitized without (EM-3) and with (EM-4) an amine borane compound. The comparative isothiazolin-one, CC-2 was added to the emulsion after treatment with amine borane compound but before the subsequent treatment with sulfur and gold sensitizers as described in Example 1. The resulting emulsions were handled as in Example 1.

TABLE 2

| Description | Compound | Level (μmol/Ag mol) | Relative Speed | D-min |
|---|---|---|---|---|
| EM-3 (control) | none | | 100 | 0.051 |
| EM-4 (control) | none | | 155 | 0.143 |
| Invention | I-1 | 100 | 186 | 0.115 |
| Invention | I-1 | 1000 | 95 | 0.055 |
| Comparison | CC-2 | 100 | 191 | 0.153 |
| Comparison | CC-2 | 1000 | 166 | 0.328 |

The results in Table 2 again show the unexpected antifogging effect from the isothiazolin-one I-1 when used prior to chemical sensitization. This effect is absent from the comparative isothiazolin-one, CC-2, which not only failed to antifog but also gave an increase in speed and fog.

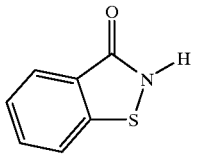

Comparative Isothiazolin-one CC-2

EXAMPLE 3

A conventional 2% iodide AgBrI ammoniacal emulsion was prepared using standard precipitation conditions to give an average grain size of 1.43 micrometers. One portion of the emulsion (EM-5) received an optimum chemical sensitization containing N-methyl-benzothiazolium iodide and potassium tetrachloroaurate. Other portions of the emulsion received either a mercuric salt, CC-1, or the isothiazolin-one I-1 before the optimum chemical sensitization. The emulsions were then mixed with additional gelatin, water, and common coating aids and cast onto a cellulose acetate support. An additional gelatin solution containing coating aids and a vinylsulfone hardener was cast on top of the emulsion layer. The resulting dried coatings containing 5380 $mg/m^2$ of silver halide and 9684 $mg/m^2$ of gelatin were exposed for 0.01 seconds with white light through a stepped-density tablet and processed for 6 minutes in Kodak rapid x-ray developer. Table 3 lists the minimum density (D-min) of the coatings and the speeds relative to the coating with no additives.

TABLE 3

| Description | Compound | Level (mg/Ag mol) | Relative Speed | D-min |
|---|---|---|---|---|
| EM-5 (control) | none | | 100 | 0.127 |
| Comparison | CC-1 | 0.9 | 151 | 0.071 |
| Invention | I-1 | 15 | 102 | 0.106 |
| Invention | I-1 | 45 | 112 | 0.097 |
| Invention | I-1 | 135 | 126 | 0.085 |
| Invention | I-1 | 595 | 151 | 0.096 |

Table 3 shows in another emulsion formulation the unexpected antifogging activity of the isothiazolin-one I-1 when used during chemical sensitization while yielding no loss in sensitivity. Additionally, the appropriate amount of isothiazolin-one can eliminate the need for the use of environmentally undesirable mercuric salts for fog control.

EXAMPLE 4

A reaction vessel contained 5 L of 7.9% gelatin, 0.038 M NaCl, and a foam-controlling agent. The contents of this vessel were maintained at 67° C. and the pCl was adjusted to 1.7. To this stirred solution was added 17.5 mL of 2.6 M $AgNO_3$ and 23.55 mL of 2.8 M NaCl simultaneously at 35 mL/min for 0.5 min. The 2.6 M $AgNO_3$ and the 2.8 M NaCl solutions were then added simultaneously with a ramped linearly increasing flow from 35 mL/min to 123 mL/min over 20 minutes. Then the 2.6 M $AgNO_3$ solution and the 2.8 M NaCl solution were added simultaneously at 123 mL/min for 42.5 minutes. The emulsion was then cooled down to 40° C. over 15 minutes. After 93 mole-% of the total silver was precipitated, 200 mL of a solution containing potassium iodide in an amount corresponding to 0.3 mole-% of the total silver precipitated was dumped into the reactor. The emulsion was then washed and adjusted to pH 5.6 and pCl 1.7. The resulting emulsion had a cubic shape and was 0.56 $\mu$m in edgelength.

This emulsion was sensitized in the following manner. A portion of emulsion was treated with a Au(I) compound (CAS Reg No. 141766-84-9), raised from 40° C. to 60° C., and then held for 20 minutes. Sensitizing dye YS-A was then added, followed after 12 minutes by sodium thiosulfate, then was held for another 15 minutes. At this point the emulsion was cooled to 40° C. followed by the addition of 1-(3-acetamidophenyl)-5-mercaptotetrazole and potassium bromide. This sensitized emulsion is denoted as EM-6.

Emulsion EM-6A was sensitized identically to EM-6, except that 0.025 mg/Ag mol of mercuric chloride was added prior to the Au(I) compound.

Emulsion EM-6B was sensitized identically to EM-6, except that 58 mg/Ag mol of isothiazolin-one I-1 was added prior to the Au(I) compound.

Emulsion EM-6C was sensitized identically to EM-6, except that 290 mg/Ag mol of isothiazolin-one I-1 was added prior to the Au(I) compound.

Emulsion EM-6D was sensitized identically to EM-6, except that 580 mg/Ag mol of isothiazolin-one I-1 was added prior to the Au(I) compound.

Emulsion EM-6E was sensitized identically to EM-6, except that 2900 mg/Ag mol of isothiazolin-one I-1 was added prior to the Au(I) compound.

These emulsions were then mixed with a yellow-dye-forming coupler dispersion containing Coupler A just prior to coating on resin coated paper support. The coatings were overcoated with a gelatin layer and the entire coating was hardened with bis(vinylsulfonylmethyl)ether. These dried coatings contained 280 mg silver per square meter and 18.3 g Coupler A per square meter. Exposure was with a 3000 K tungsten source for 0.1 second, and development was obtained with RA-4 process. Speed was determined at a point on the D-logE curve corresponding to 1.0 density, Toe was determined at a point on the D-logE curve that was 0.3 logE less than 1.0 density, Shoulder was determined at a point on the D-logE curve that was 0.3 logE greater than 1.0 density.

TABLE 4

| Emulsion | D-min | Speed | Toe | Shoulder |
|---|---|---|---|---|
| EM-6 (comparison) | 0.633 | 150 | 0.838 | 1.244 |
| EM-6A (comparison) | 0.073 | 55 | 0.487 | 1.844 |
| EM-6B (invention) | 0.080 | 54 | 0.529 | 1.872 |
| EM-6C (invention) | 0.067 | 54 | 0.448 | 1.581 |
| EM-6D (invention) | 0.067 | 54 | 0.453 | 1.414 |
| EM-6E (invention) | 0.062 | 54 | 0.214 | 0.807 |

The results in Table 4 demonstrate the unexpected beneficial effects of the isothiazolin-one I-1 when added prior to the chemical sensitization of a silver iodo-chloride emulsion. These effects were not seen when I-1 was added at the same levels after chemical sensitization. Furthermore, similar antifogging benefits are obtained relative to mercuric chloride, which alleviates the need for using environmentally undesirable antifoggants during emulsion manufacture.

Coupler A

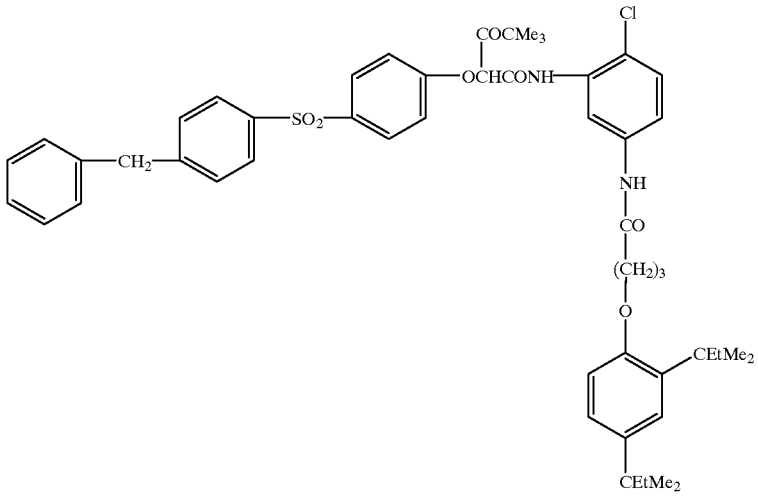

Sensitizing Dye YS-A

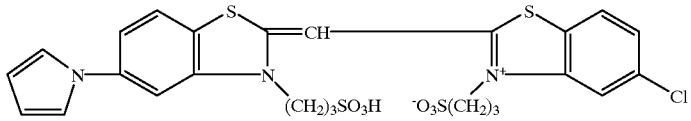

EXAMPLE 5

This example employs a tabular, structured bromoiodide emulsion in which the iodide is added as a $NaBr_{0.50}I_{0.50}$ solution at 70% of the total silver just prior to performing a silver over-run. The emulsion was prepared in the presence of growth modifier, Pluronic-31R1™, to produce grains of a uniform size. The procedurewas based on that described by Fenton et. al. in U.S. Pat. No. 5,476,760. The emulsion consisted of grains 2.2×0.124 μm containing 3.8% iodide. Following ultrafiltration to remove excess salts it was divided into two parts. Part 1 was treated with 182 mg/Ag mol B-1 and Part 2 was treated with 61 mg/Ag mol I-1.

Each part was treated sequentially with sodium thiocyanate; magenta sensitizing dyes, MS-A and MS-B; sodium aurous dithiosulfate; sodium thiosulfate; finish modifier, FM; then heated to 65° C. and held for varying times, cooled to 40° C., and treated with antifoggant, AF. Sensitized emulsion Part 1 will be designated E-7A and sensitized emulsion Part 2 will be designated E-7B.

Sensitizing Dye MS-A

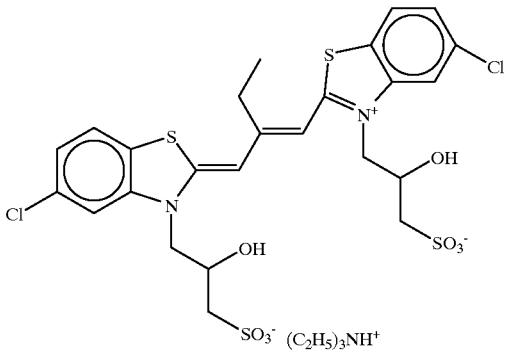

-continued

Sensitizing Dye MS-B

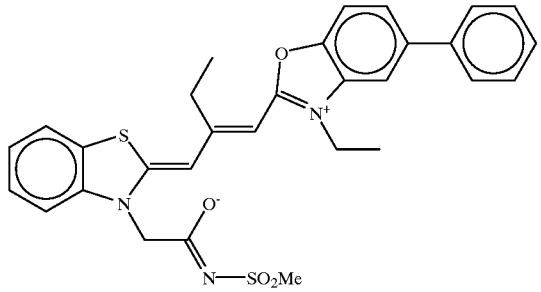

Finish Modifier FM

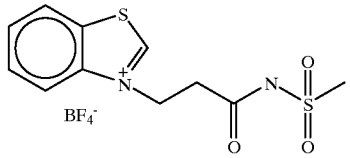

Antifoggant AF

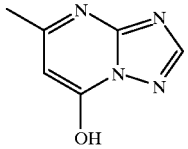

The sensitized emulsion samples were coated in a simple single layer format which consisted of a pad of gelatin on a cellulose acetate film support with an antihalation backing covered by a layer containing the emulsion and the image forming Coupler B, together with a development inhibitor releasing Coupler C. The emulsion layer was protected from abrasion by a gelatin overcoat containing hardener. A detailed description of the layered structure is described below.

The dried coated samples were given 0.01 s Wratten 2B filtered daylight (5500° K) exposure through a 21 step calibrated neutral density step tablet. The exposed samples were developed in the color negative Kodak Flexicolor™ C41 process. Speed values are linear relative to the fastest example in a given set. Contrast was measured as the maximum slope in the linear region of the density vs. exposure curve.

Coupler B

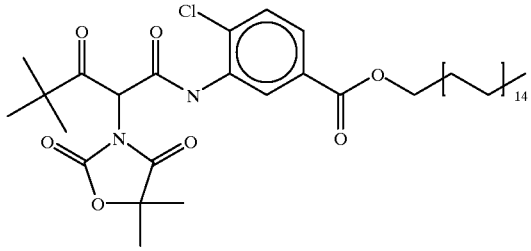

Coupler C

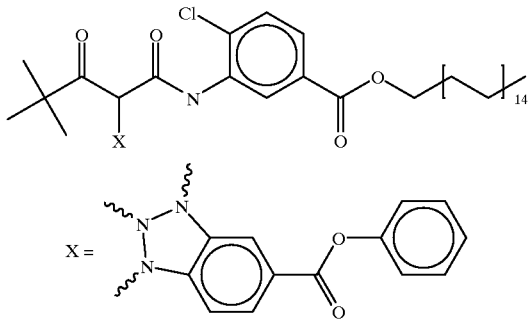

Single Layer Format

| Coated Layer | Composition |
|---|---|
| Protective Overcoat | 2.15 g/m$^2$ gelatin |
| Emulsion/Coupler | 3.23 g/m$^2$ gelatin<br>0.86 mg/m$^2$ Ag<br>1.08 g/m$^2$ coupler B<br>0.3 g/m$^2$ coupler C<br>0.004 g/m$^2$ antifoggant AF |
| Gelatin Pad | 4.89 g/m$^2$ gelatin |
| Support | Cellulose Acetate |

TABLE 5

| Emulsion | Biocide | Heating Time (min) | D-min | Relative Speed | Contrast |
|---|---|---|---|---|---|
| E-7A1 (comparison) | B-1 | 11 | 0.069 | 79 | 1.72 |
| E-7A2 (comparison) | B-1 | 13 | 0.104 | 91 | 1.74 |
| E-7A3 (comparison) | B-1 | 15 | 0.138 | 95 | 1.62 |
| E-7A4 (comparison) | B-1 | 17 | 0.225 | 91 | 1.46 |
| E-7A5 (comparison) | B-1 | 19 | 0.292 | 95 | 1.40 |
| E-7B1 (invention) | I-1 | 11 | 0.065 | 79 | 1.97 |
| E-7B2 (invention) | I-1 | 13 | 0.083 | 93 | 1.96 |
| E-7B3 (invention) | I-1 | 15 | 0.086 | 95 | 1.93 |
| E-7B4 (invention) | I-1 | 17 | 0.116 | 100 | 1.86 |
| E-7B5 (invention) | I-1 | 19 | 0.134 | 98 | 1.76 |

As shown in Table 5, the emulsion treated with I-1 reaches an optimum speed/fog position (E-7B4) that is higher in speed and lower in fog than the emulsion treated with B-1 (E-7A3). Furthermore, E-7B is much less prone to fog formation with increasing heat input, thereby providing a more robust sensitization. A further benefit of I-1 is the higher contrast attained in all examples.

EXAMPLE 6

This example employs a tabular, run/dump, bromoiodide emulsion in which the first portion of iodide is added simultaneously with bromide and the second iodide addition is done abruptly by dumping into the reaction vessel a silver iodide seed emulsion and then performing a silver over-run. A 0.25 M silver nitrate solution was added at the rate of 35 mL/min for 15 min into a reaction vessel with good stirring and containing 18.4 g of oxidized, lime-processed, bone gelatin, 33.2 g sodium bromide, and antifoamant in 4.6 L of distilled water maintained at 58° C. Following nucleation, an ammonia digest was performed with 0.025 moles of ammonia at pH 10 for 5 min. An additional 222 g of oxidized, lime-processed, bone gelatin together with additional antifoamant in 2.4 L of distilled water was added and the pH was adjusted to 5.5. Growth was conducted over a period of 46 min by the equimolar addition of 3.0 M silver nitrate with $NaBr_{0.99}I_{0.01}$ in a double-jet mode maintaining a pBr of 1.70. The silver flow rate was ramped during this time from 7.4 to 170.5 mL/min delivering 68% of the total silver for the make. During this growth period 36 mg/Ag mol $K_4Ru(CN)_6$ was delivered to the reaction vessel in 1 min when 33% of the total silver had been delivered. 70 $\mu$g/Ag mol of KSeCN was added followed by 3.0 M $NaBr_{0.99}I_{0.01}$ at the rate of 200 mL/min for 2 min. 0.38 mol of silver iodide seeds was added and then a silver over-run was performed by adding 3.0 M silver nitrate at the rate of 50 mL/min for 24 min. A balancing flow of 3.0 M NaBr was used to limit the drop in bromide concentration to a pBr of 2.46. Excess salt was removed by ultrafiltration to yield 12.6 moles of emulsion containing an average of 3.8% iodide with a grain size of 2.8×0.106 $\mu$m. Following ultrafiltration to remove excess salts, the emulsion was divided into four parts: Part 1 was treated with 175 mg/Ag mol B-1, Part 2 was treated with 350 mg/Ag mol B-2, Part 3 was treated with 8.7 mg/Ag mol B-3, and Part 4 was treated with 58 mg/Ag mol I-1.

Each part was treated sequentially with sodium thiocyanate; finish modifier, FM; cyan spectral sensitizing dyes, CS-A and CS-B; sodium aurous dithiosulfate and sodium thiosulfate. They were then heated to 61° C. for 8 min, cooled to 40° C., and antifoggant AF was added. Emulsion Part 1 will be designated E-8A, Part 2 E-8B, Part 3 E-8C, and Part 4 E-8D. The examples were tested by coating in the single layer format used in Example 5.

Sensitizing Dye CS-A

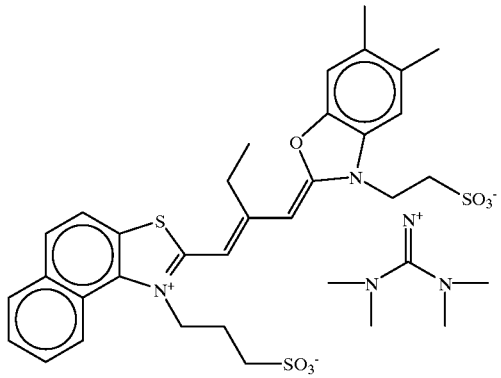

Sensitizing Dye CS-B

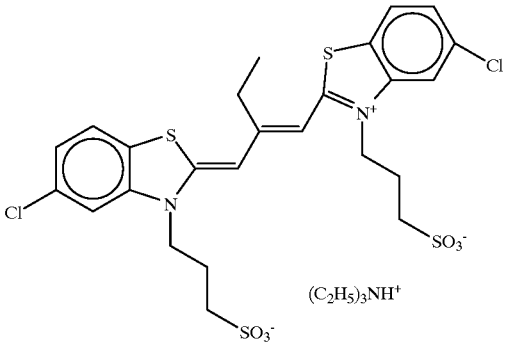

Biocide B-2

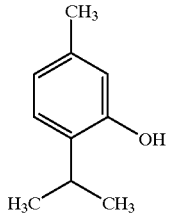

Biocide B-3

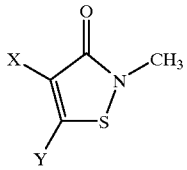

X, Y = H,Cl @ 75%/H,H @ 24%/Cl,Cl @ 1%

TABLE 6

| Emulsion | Biocide | D-min | Relative Speed | D-min Change | Speed Change |
|---|---|---|---|---|---|
| E-8A (comparison) | B-1 | 0.204 | 95 | | |
| E-8A + heat (comparison) | B-1 | 0.201 | 89 | −0.003 | −6 |
| E-8B (comparison) | B-2 | 0.160 | 100 | | |
| E-8B + heat (comparison) | B-2 | 0.264 | 89 | 0.104 | −11 |
| E-8C (comparison) | B-3 | 0.127 | 100 | | |
| E-8C + heat (comparison) | B-3 | 0.190 | 91 | 0.063 | −9 |
| E-8D (invention) | I-1 | 0.096 | 100 | | |
| E-8D + heat (invention) | I-1 | 0.121 | 100 | 0.025 | 0 |

The photographic benefit of I-1 relative to other common biocides is further demonstrated in Table 6 comparing the photographic response of the freshly sensitized emulsions as well as those made following a 3-hour heating period at 50° C. In all cases isothiazolin-one I-1 produced lower fog levels at equal or greater speeds and demonstrated the further benefit of maintaining the fresh speed following the heating period.

EXAMPLE 7

In accordance with the present invention, isothiazolin-one I-1 (amounts indicated in Table 7) was added to 0.3 mol of a negative silver iodochloride emulsion (0.2% iodide introduced in the course of the precipitation of the emulsion at 90% of total silver added) prior to (position A) introduction of a solution of p-glutaramidophenyl disulfide (4 mg/Ag mol). This was followed by addition of a colloidal suspension of aurous sulfide (16.8 mg/Ag mol) at 40° C. The emulsion was heated to 58.9° C. at a rate of 10° C. per 6 minutes and then held at this temperature for 75.5 minutes. During this time, a blue spectral sensitizing dye, anhydro-5-chloro-3,3'-di(3-sulfopropyl)-5'-(1-pyrrolyl)-thiazolothiacyanine hydroxide triethylammonium salt (200 mg/Ag mol), a suspension of Lippman bromide (357 mg/Ag mol), 1-(3-acetamidophenyl)-5-mercaptotetrazole (89 mg/Ag mol) were added. The emulsion was cooled back to 40° C. at a rate of 10° C. per 6 minutes. This emulsion further contained a yellow dye-forming coupler alpha-(4-(4-benzyloxy-phenyl-sulfonyl)phenoxy)-alpha(pivalyl)-2-chloro-5-(gamma-(2,4-di-5-amylphenoxy)butyramido) acetanilide (1.08 g/m$^2$) in di-n-butylphthalate coupler solvent (0.27 g/m$^2$), gelatin (1.51 g/m$^2$). The emulsion (0.34 g Ag/m$^2$) was coated on a resin coated paper support and 1.076 g/m$^2$ gel overcoat was applied as a protective layer along with the hardener bis (vinylsulfonyl) methyl ether in an amount of 1.8% of the total gelatin weight.

For samples 7–11, isothiazolin-one I-1 was added when the emulsion was cooled to about 45° C. (position B) after the heat rise, instead of at the beginning of the sensitization.

The coatings were given a 0.1 second exposure, using a 0–3 step tablet (0.15 increments) with a tunsten lamp designed to stimulate a color negative print exposure source. This lamp had a color temperature of 3000 K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

| Developer | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |

-continued

| Bleach-fix | |
|---|---|
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2. | |

The data in Table 7 show the changes in fog density of the blue sensitized coatings after a two and four week storage at 120° F. relative to those kept at 0° F. Fog is measured as the minimum density (Dmin) above zero. The speed taken at the 1.0 density point of the D log E curve is taken as a measure of the sensitivity of the emulsion.

It can be seen in Table 7 that samples of the present invention (2–6) when added at position (A) have reduced fog growth after either a two or four weeks of storage compared to the control (sample 1) that does not have the compound of the present invention. Additionally, at an optimum level such as that at about 60 mg/Ag mol, the fog reduction is achieved without any loss in emulsion sensitivity. When isothiazolin-one I-1 is added later during the sensitization as in position (B), the samples (7–11) do not have the fog reduction as those in samples 2–6.

TABLE 7

| | | mg Ag | | Fresh | | 2 week | | 4 week | |
|---|---|---|---|---|---|---|---|---|---|
| Sample | Cpd | mol | Pos | Spd | D-min | Δ Spd | Δ D-min | Δ Spd | Δ D-min |
| 1 (comparison) | none | — | — | 143 | 0.064 | 16 | 0.028 | 27 | 0.134 |
| 2 (invention) | I-1 | 6 | A | 143 | 0.065 | 17 | 0.022 | 28 | 0.119 |
| 3 (invention) | I-1 | 60 | A | 143 | 0.063 | 15 | 0.016 | 23 | 0.081 |
| 4 (invention) | I-1 | 239 | A | 141 | 0.070 | 11 | 0.009 | 19 | 0.054 |
| 5 (invention) | I-1 | 600 | A | 129 | 0.060 | 10 | 0.006 | 17 | 0.035 |
| 6 (invention) | I-1 | 1200 | A | 131 | 0.060 | 8 | 0.005 | 17 | 0.033 |
| 7 (comparison) | I-1 | 6 | B | 143 | 0.059 | 15 | 0.019 | 28 | 0.124 |
| 8 (comparison) | I-1 | 60 | B | 144 | 0.062 | 17 | 0.022 | 26 | 0.121 |
| 9 (comparison) | I-1 | 239 | B | 144 | 0.069 | 18 | 0.023 | 27 | 0.131 |
| 10 (comparison) | I-1 | 600 | B | 144 | 0.061 | 14 | 0.020 | 26 | 0.120 |
| 11 (comparison) | I-1 | 1200 | B | 144 | 0.063 | 18 | 0.016 | 26 | 0.111 |

The invention has been described in detail with particular reference to certain preferred embodiments thereof, but it will be understood that variations and modifications can be effected within the spirit and scope of the invention.

What is claimed is:

1. A silver halide photographic element comprising a silver halide emulsion chemically sensitized in the presence of an isothiazolin-one compound represented by the formula

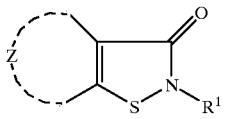

wherein $R^1$ is a substituent; and Z is a substituted or unsubstituted saturated ring, wherein the isothiazolin-one compound was added after precipitation of the emulsion.

2. The silver halide photographic element of claim 1 wherein Z is a substituted or unsubstituted five or six-membered saturated ring.

3. The silver halide photographic element of claim 2 wherein wherein Z is a substituted or unsubstituted five-membered saturated ring.

4. The silver halide photographic element of claim 1 wherein $R^1$ is a hydrogen atom or a substituted or unsubstituted aliphatic aromatic or heterocyclic group.

5. The silver halide photographic element of claim 2 wherein $R^1$ is a hydrogen atom or a substituted or unsubstituted aliphatic aromatic or heterocyclic group.

6. The silver halide photographic element of claim 1 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6- membered heterocyclic ring.

7. The silver halide photographic element of claim 2 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6- membered heterocyclic ring.

8. The silver halide photographic element of claim 3 wherein $R^1$ is a hydrogen atom or a substituted or unsubstituted alkyl group having 1 to 6 carbon atoms.

9. The silver halide photographic element of claim 1 wherein the amount of isothiazolin-one compound contained in the emulsion is from 0.02 to 50 mmol/Ag mol.

10. The silver halide photographic element of claim 1 wherein the amount of isothiazolin-one compound contained in the emulsion is from 0.1 to 5 mmol/Ag mol.

11. A method of preparing a silver halide emulsion comprising precipitating and chemically sensitizing the emulsion and after precipitation but before or during chemical sensitization adding to the emulsion an isothiazolin-one compound represented by the formula

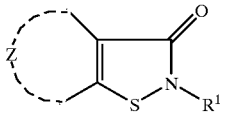

wherein $R^1$ is a substituent; and Z is a substituted or unsubstituted saturated ring.

12. The method of claim 11 wherein Z is a substituted or unsubstituted five or six-membered saturated ring.

13. The method of claim 12 wherein wherein Z is a substituted or unsubstituted five-membered saturated ring.

14. The method of claim 11 wherein $R^1$ is a hydrogen atom or a substituted or unsubstituted aliphatic aromatic or heterocyclic group.

15. The method of claim 12 wherein $R^1$ is a hydrogen atom or a substituted or unsubstituted aliphatic aromatic or heterocyclic group.

16. The method of claim 11 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6- membered heterocyclic ring.

17. The method of claim 12 wherein $R^1$ is a hydrogen atom or a substituted or unsubstituted alkyl group having 1 to 6 carbon atoms, a substituted or unsubstituted aryl group having 6 to 10 carbon atoms or a substituted or unsubstituted 5 to 6- membered heterocyclic ring.

18. The method of claim 13 wherein $R^1$ is a hydrogen atom or a substituted or unsubstituted alkyl group having 1 to 6 carbon atoms.

19. The method of claim 11 wherein the amount of isothiazolin-one compound added is from 0.02 to 50 mmol/Ag mol.

20. The method of 11 wherein the amount of isothiazolin-one compound added is from 0.1 to 5 mmol/Ag mol.

21. The method of claim 11 wherein the isothiazolin-one compound is added before the start of chemical sensitization.

* * * * *